US007152694B2

(12) United States Patent
Dennis

(10) Patent No.: US 7,152,694 B2
(45) Date of Patent: Dec. 26, 2006

(54) POST DRIVER

(76) Inventor: Larry A. Dennis, 3212 Houston-Antioch Rd., Paris, KY (US) 40361

( * ) Notice: Subject to any disclaimer, the term of this patent is extended or adjusted under 35 U.S.C. 154(b) by 213 days.

(21) Appl. No.: 10/365,670

(22) Filed: Feb. 12, 2003

(65) Prior Publication Data

US 2003/0178212 A1 Sep. 25, 2003

Related U.S. Application Data

(60) Provisional application No. 60/356,193, filed on Feb. 12, 2002.

(51) Int. Cl.

| | |
|---|---|
| ***E21B 19/06*** | (2006.01) |
| ***E21B 19/08*** | (2006.01) |
| ***E21B 19/087*** | (2006.01) |
| *E21B 41/02* | (2006.01) |

(52) U.S. Cl. ..... 173/184; 173/90; 173/91; 173/100; 173/185

(58) Field of Classification Search ..... 173/90, 173/91, 28, 27, 131, 100, 128, 184, 185
See application file for complete search history.

(56) References Cited

U.S. PATENT DOCUMENTS

| | | | | |
|---|---|---|---|---|
| 1,996,401 A | | 4/1935 | Bowen | 61/77 |
| 2,731,892 A | | 1/1956 | Simmonds | 94/49 |
| 3,481,649 A | | 12/1969 | Ericsson | 299/37 |
| 3,482,639 A | | 12/1969 | Mixon | 173/27 |
| 3,744,578 A | | 7/1973 | Lisenby | |
| 3,961,672 A | | 6/1976 | Welsch et al. | 173/43 |
| 4,050,526 A | * | 9/1977 | Deike | 173/27 |
| 4,124,081 A | * | 11/1978 | Deike | 173/28 |
| 4,249,600 A | | 2/1981 | Bailey | 166/77 |
| 4,336,840 A | | 6/1982 | Bailey | 166/77 |
| 4,565,251 A | * | 1/1986 | Cischke | 173/128 |
| 4,802,538 A | | 2/1989 | Hays et al. | 173/1 |
| 4,993,500 A | | 2/1991 | Greene et al. | 173/1 |
| 5,819,857 A | | 10/1998 | Rohrer | 173/90 |
| 6,003,619 A | | 12/1999 | Lange | 173/184 |
| 6,305,480 B1 | * | 10/2001 | Franklin | 173/27 |

FOREIGN PATENT DOCUMENTS

| | | | |
|---|---|---|---|
| RU | 185669 | 1/1967 | 173/90 |
| RU | 1543012 | 2/1990 | 173/90 |

* cited by examiner

*Primary Examiner*—Louis K. Huynh
*Assistant Examiner*—Nathaniel Chukwurah
(74) *Attorney, Agent, or Firm*—Lawrence R. Leston

(57) ABSTRACT

A post driver is powered by a pair of hydraulic cylinders, one on either side of the hammer to provide a balanced lifting force to the hammer. A post retaining cap is formed to provide a recess for the post. The orientation of the driver may be controlled about a horizontal axis so the post may be driven vertically without regard to the contour of the ground. The post driver is further provided with an extensible beam and foot which is extended to engage the ground and further support the driver.

14 Claims, 3 Drawing Sheets

24
22
18
49
50
86
14
26
30
24
76
70
82
72
78
80
74
16
31
17
84
48
68
64
52
24
66
62

POST DRIVER

PRIORITY APPLICATION

This Application claims priority from U.S. Provisional Application, Ser. No. 60/356,193 filed on Feb. 12, 2002.

FIELD OF THE INVENTION

The present invention is related, in general, to devices for driving posts into the ground during the construction of fences, guard railing, and the like. More particularly, the invention relates to a post driver which may be fitted to a vehicle for mobility, and which is adjustable to allow driving a post at any desired angle corresponding to the contours of the ground in which it is driven. The mobile post driver of this invention further includes a means for retaining a post being driven in place, thereby eliminating the need for the user to manually hold the post in place during the initial phases of the driving operation.

BACKGROUND OF THE INVENTION

It is known to use mechanical post driving devices to achieve the driving of posts of relatively large cross-section into the ground during the construction of fences, guard railings, and the like. These prior art devices generally operate by use of a large, heavy hammer assembly which is raised and dropped on the post, striking the post, and thereby driving it into the ground at a desired site. Prior art post driving devices often are designed to be affixed to a vehicle, improving ease of use and allowing the user to quickly and efficiently place a large number of posts at the desired location during fence construction.

Prior art post driving devices, including those for which operation of the hammer assembly is achieved by means of hydraulic pressure or by a cable-type assembly, place the hammer lifting means at the rear of the hammer assembly between the post driver and the vehicle to which it is mounted. Prior art devices also often require the user to manually hold the post being driven in place during the initial strikes of the post driving operation, thereby increasing risk to the user.

Such devices, in general, are effective for their intended purpose. However, placement of the hammer lifting means at the rear of the hammer assembly results in certain disadvantages. In order to efficiently drive a post of relative large cross-section, the hammer assembly must be of relatively large weight and mass. Lifting and dropping such a hammer assembly using only a rear-mounted hydraulic cylinder or cable may result in significant tilting of the post driver during the striking operation due to the offset placement of the hammer assembly relative to the hammer lifting means.

Additionally, in order to be effective, the hammer assembly must be offset relative to the vehicle to which it is mounted, further contributing to the instability of the post driver. Accordingly, there is need in the art for a post driving device which overcomes this limitation in the prior art devices. There also is a need for a mobile post driver which obviates the need for a user to manually hold a post in place.

SUMMARY OF THE INVENTION

The post driver of the present invention is constructed to be supported by a vehicle, such as a tractor or large truck. The device of this invention is particularly suited for driving posts having a large cross-section into the ground such as, for example, large wooden fence posts used in constructing plank fencing.

The mobile post driver of the present invention includes a hammer assembly constructed of a material of sufficient strength and weight to drive a post into soils of varying consistency and resistance. The device includes lifting means for lifting the hammer assembly to a desired height prior to dropping the hammer on a post, thereby driving the post into the ground by impact forces. The device further includes a means for retaining a post in place during the driving operation as well as an adjustable stabilizing means for stabilizing the post driver during operation.

In a preferred embodiment of the present invention, the mobile post driver comprises a frame for supporting a hammer assembly, a swiveling means for mounting the frame to a vehicle, a lifting means for raising the hammer assembly to a desired height, an adjustable stabilizer for stabilizing the post driver during operation, and a means for retaining a post in place during the driving operation. Placed on either side of the hammer assembly are two means for lifting the hammer assembly. The hammer lifting means are provided interior to the frame, affording increased stability during the raising and lowering phases of a post driving operation. The frame also includes a stabilizing means comprising a beam and foot assembly which may be raised or lowered to the ground to provide an additional stabilizing point, thereby improving the stability of the device during operation.

The post driver of the present invention further includes a retention means for retaining a post in place during the driving operation. In a preferred embodiment, the retention means comprises a cap of sufficient size to accommodate the post being driven. The cap includes a recessed portion for contacting the upper surface of the post, thereby keeping the post in a desired alignment. The cap fiber may include metal studs or pins in the recessed portion, securing the post in the desired alignment.

The post driver of the invention additionally includes a mounting means for mounting the driver to a vehicle, thereby rendering the post driver mobile. Advantageously, the mounting means allows the alignment of the post driver to be altered in accordance with the contours of the ground into which the post is to be driven. Regardless of the specific contour of the ground into which the post is driven, it will be appreciated that this feature allows the driving of posts into the ground in a substantially perpendicular orientation to the ground.

Additional advantages and other novel features of the invention will be set forth in part in the description that follows and will become apparent to those skilled in the art from the Detailed Description of the Invention to follow.

DETAILED DESCRIPTION OF THE INVENTION

Figure 1:
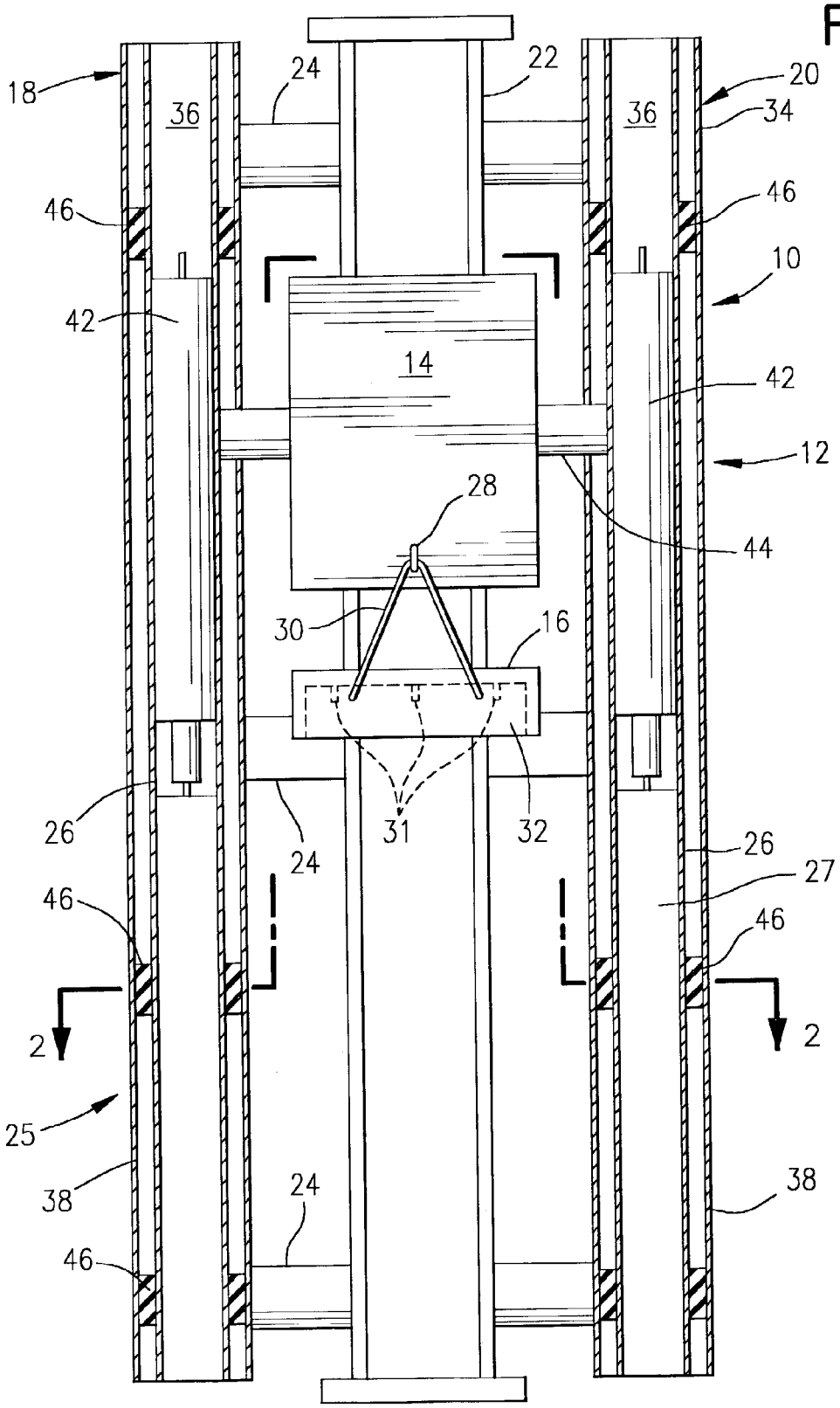
FIG. 1 is a frontal view of the post driver of the invention.
Figure 2:
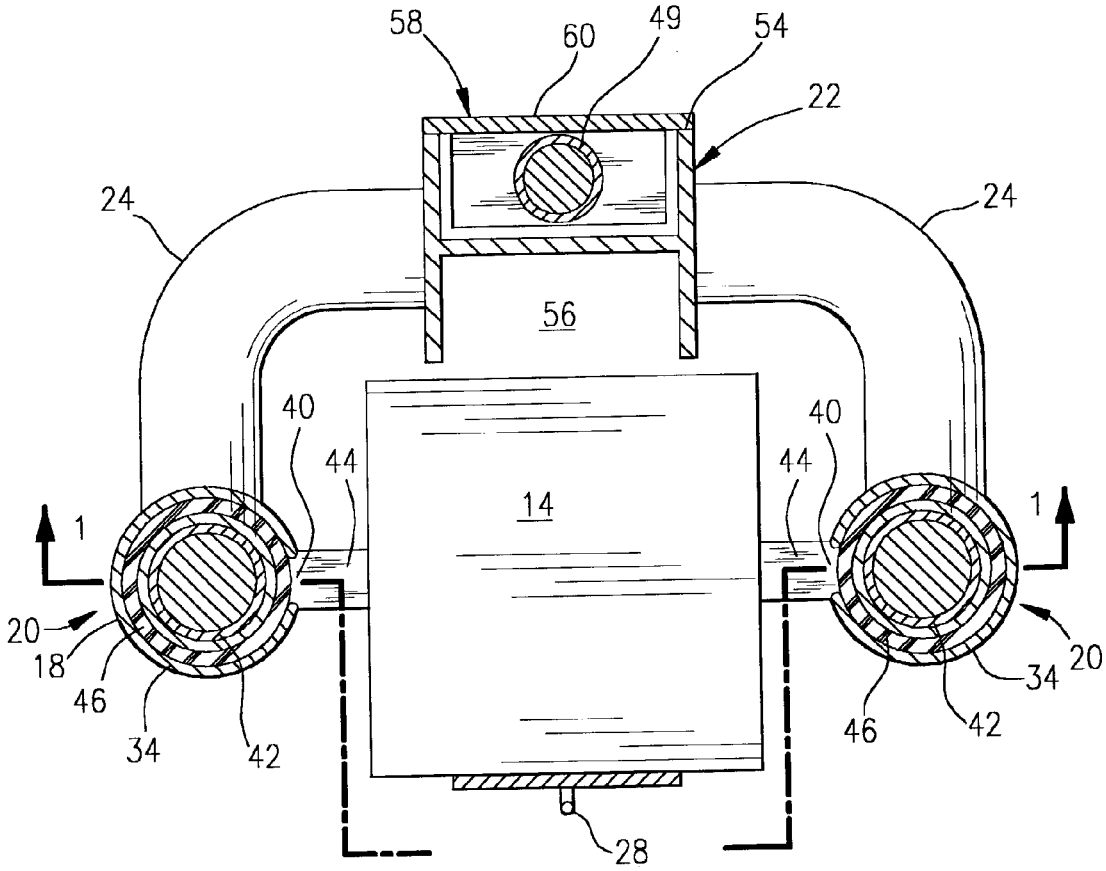
FIG. 2 is a section view of the post driver of the invention taken along line 2—2 of FIG. 1

Referring to FIG. 1, the post driver 10 of this invention comprises a frame 12, a hammer assembly 14, and a post retaining cap 16. The frame 12 comprises a left support 18, right support 20, and rear support 22. Left support 18, right support 20, and rear support 22 are connected by cross-members 24. As will be appreciated from FIG. 2 and the description below, the left support 18, right support 20, rear support 22, and cross-members form a cage 25 into which hammer assembly 14 and post retaining cap 16 are slidably inserted. Accordingly, hammer assembly 14 and post retaining cap 16 are slidably retained for vertical movement within frame 12. In the preferred embodiment best visualized in FIG. 2, the frame 12 is substantially "C-shaped," with the hammer assembly 14 and post retaining cap 16 slidably retained within the frame 12.

The hammer assembly 14 is of standard design. In a presently preferred embodiment, a rectangular hammer assembly 14 is provided having sufficient weight and mass to effectively drive a post (not shown) of desired dimensions into soil of varying consistency and resistance. However, it should be appreciated that any desired shape of hammer may be employed such as, for example, a cylindrical hammer. The hammer assembly 14 is operably connected to hammer lifting means 26 as will be described below. The hammer assembly 14 further includes a peg or bolt 28 for supporting he post retaining cap 16.

Figure 3:
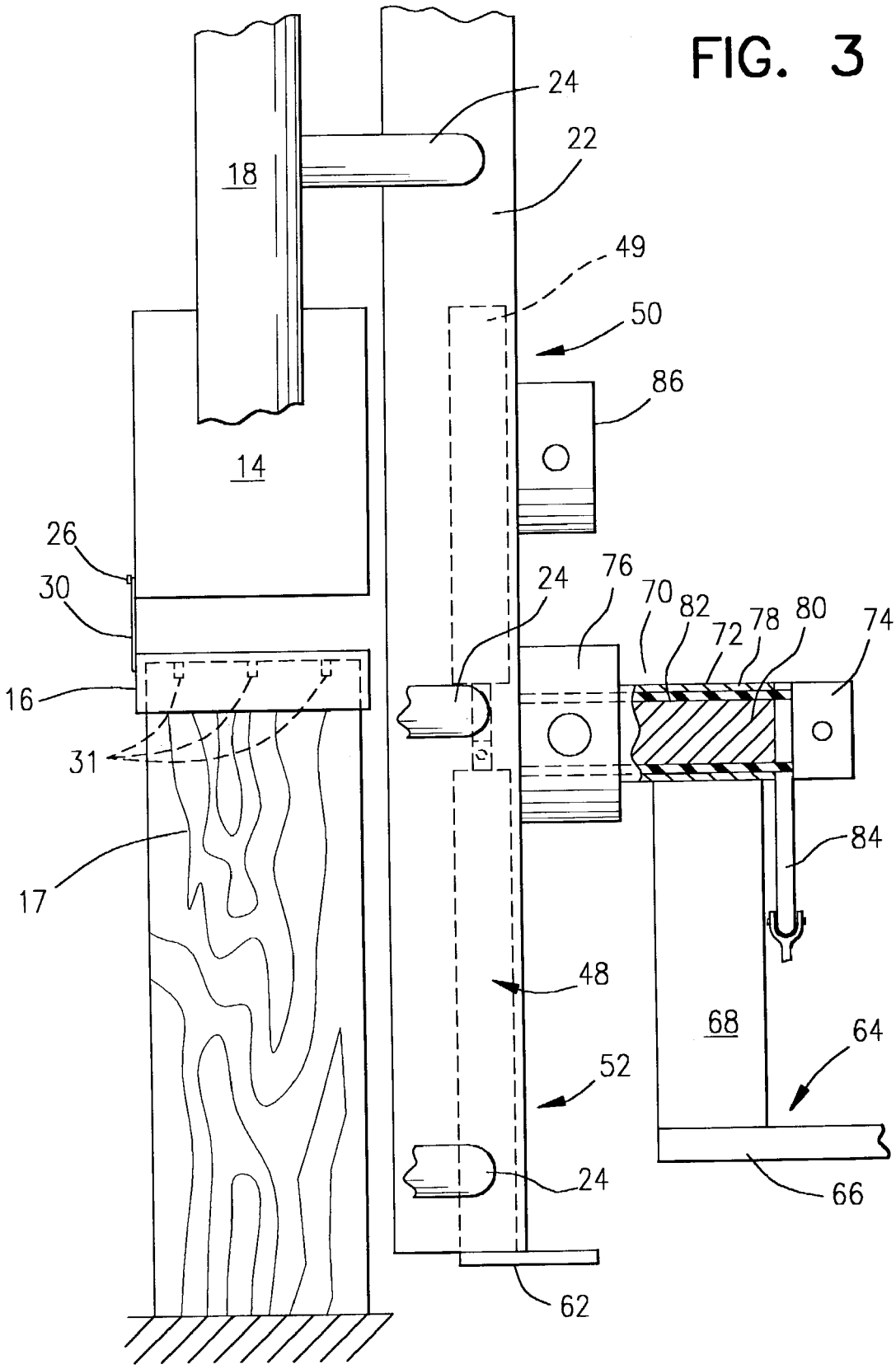
FIG. 3 is a section view of the post driver of the invention taken along line 3—3 of FIG. 2.

In the presently preferred embodiment, the post retaining cap 16 is a rectangular block large enough to substantially overlay a post 17 of desired size, as best seen in FIGS. 1 and 3. The post retaining cap 16 is releasably supported on the hammer assembly 14 by means of a cable 30 affixed to the post retaining cap 16 at either end and releasably connected to peg or bolt 28 at the middle. The post retaining cap 16 includes a recess 32 which is designed to fit over the top surface of a post 17 to be struck. The recess 32 also may include studs or pins 31 which engage the surface of the post 17 to be struck.

In a preferred embodiment of the present invention, hammer lifting means 26 are incorporated into the left frame support 18 and the right frame support 20. Using left frame support 18 as an example, the exterior of the left frame support 18 comprises a hollow tube 34 having an upper portion 36 and a lower portion 38. Upper portion 36 contains a channel 40 therethrough which allows the cross member 44 or ear 44 of hammer 14 to engage the hollow interior of tube 34. Moreover, it will be appreciated that channels 40 therefore provide a path of travel for the hammer assembly 14 to slide vertically along a partial length of the left frame support 18 and the right frame support 20. The hammer lifting means 26 further includes hydraulic cylinders 27 and interior metal rods 42, which are slidably inserted into the interior of the hollow tubes 34. The interior metal rods 42 include an ear 44 projecting therefrom, not only oriented along the longitudinal axis of the rods 42 but also configured to be cooperatively received in channels 40. The ears 44 are connected to the hammer assembly 14 by any desired means, such as by welding. The tubes 34 are illustrated as cylindrical but also may be rectangular or square in cross-section.

The interior metal rods 42 and, thereby, the hammer assembly 14 connected thereto are raised and lowered by hydraulic cylinders 27 located in the lower portion 38 of the hollow tubes 34. Interior metal rods 42 are separated from the hollow tubes 34 by a plurality of bushings 46. It will be appreciated that any suitable means for reducing friction may be utilized as lubricated bearings between the interior metal rods 42 and the hollow tubes 34. In a presently preferred embodiment, friction between the interior metal rods 42 and the hollow tubes 34 is minimized by use of a plurality of bushings 46 composed of a lubricant-impregnated plastic, thereby eliminating the need for periodically lubricating the bushings 46. Such lubricant-impregnated plastics are known in the art and are sold under various trade names such as, for example, NYOIL™.

As best seen in FIG. 3, the frame 12 also includes incorporated into the rear support 22, a stabilizing means 48 which has a top portion 50 and a bottom portion 52. The rear support 22 comprises a substantially "I-shaped" member 54 (best seen in FIG. 2) having a front portion 56 and a back portion 58. The stabilizing means 48 is slidably retained within the back portion 58 of the I-shaped member 54 of rear support 22 by cross-pieces 60. Stabilizing means 48 comprises a beam and foot assembly 62 slidably retained by the bottom portion 52 of the rear support 22. In a presently preferred embodiment, stabilizing means 48 is connected to and, therefore, may be raised and lowered by a hydraulic cylinder 49 located in the top portion 50 of the rear support 22. As will be described in greater detail below, during operation of the post driver 10, the stabilizing means 48 is lowered into supporting contact with the ground into which the post 17 is being driven, which thereby provides an additional point of support for the driver 10 and enhances stability of this device during operation.

The post driver 10 of the present invention further includes a mounting means 64 for mounting to a vehicle (not shown). Depending upon user preference, it will be appreciated that the post driver 10 may be mounted to the front, back, or side of a vehicle. In the presently preferred embodiment of the invention, best seen in FIG. 3, the mounting means 64 comprises at least one slide channel 66 configured to cooperatively receive a correspondingly sized bar (not shown) attached to a vehicle and extending laterally therefrom. A vertical beam 68 extends from the slide channel 66 and is connected to a swivelling connector 70.

As seen in FIG. 3, the swivelling connector 70 comprises a cylindrical swivel mount 72 and a rear attachment bracket 74. Cylindrical swivel mount 72 connects to rear support 22 by means of a first bracket 76 and includes a hollow external tube 78 as well as an internal tube 80 rotatably received within hollow external tube 78. The hollow external tube 78 and internal tube 80 are separated by plastic bushings 82 to reduce friction as described supra. Cylindrical swivel mount 72 further includes a rocker arm 84 attached to internal tube 80 which allows the bracket 76 and, thereby, the rear support 22 and post driver 10 to be tilted from side to side. In the presently preferred embodiment, movement of rocker arm 84 and, subsequently, the desired side-to-side tilting of post driver 10 is accomplished by means of a hydraulic cylinder (not shown).

The rear attachment 74 of the swivelling connector 70 is operably connected to the rear support 22 at a second bracket 76, thereby allowing the post driver 10 to be tilted forwards and backwards, also by means of a hydraulic cylinder (not shown). The hydraulic cylinder (not shown) may be attached to bracket 86. It will be appreciated that this arrangement permits orientation of the post driver 10 relative to the ground to be adjusted as needed regardless of the contours of the ground into which a post is to be driven.

Reference is now made to use of a preferred embodiment of the present invention. A vehicle with the post driver 10 mounted thereon is positioned such that the post driver 10 is located directly above the site wherein a post is to be driven. As needed, the post driver 10 is tilted by means of the swivelling connector 70, either side to side, and forward or backwards by the hydraulic cylinder (not shown) attached to the second bracket 86 attached to the rear support 22, or both, to ensure that the post will be driven into the ground in a substantially perpendicular orientation. Stabilizing means 48 then is lowered until the beam 40 and foot 62 assembly is in contact with the ground.

The post to be driven is positioned under hammer assembly 14. Hammer assembly 14 then is lifted using hammer lifting means 26 such that the path of the hammer assembly 14 is defined by channels 40 in the left frame support 18 and the right frame support 20. Of course, the post retaining cap 16, which is releasably attached to the hammer assembly 14 by cable 30, also is raised. In the presently preferred embodiment of the invention, the hydraulic pressure by which the hammer assembly 14 is lifted then is released. Gravity causes the hammer assembly 14 and post retaining cap 16 to fall into contact with the post. However, it will be appreciated that alternative means for accelerating the hammer assembly 14 into contact with a post may be employed as a feature of the present invention. For example, a spring arrangement could be employed to accelerate the downstroke of the hammer assembly 14 rather than relying only on gravity.

At this first strike of the hammer assembly 14 and post retaining cap 16, the post is fitted into the recess 32 and brought into contact with the studs or pins 31 therein. In the case of a wooden post, the studs or pins 31 arc driven a short distance into the wood of the post. Cable 30 is automatically released from contact with the peg or bolt 28 on hammer assembly 14; now the hammer assembly 14 is free to operate independently of the post retaining cap 16. Accordingly, the post retaining cap 16 will retain the post in place during the remainder of the post driving operation. The hammer assembly 14 then is lifted and dropped as described supra until the post has been driven a desired distance into the ground. At that point, the cable 30 is manually reattached to the peg or bolt 28 on the hammer assembly 14, and the hammer assembly 14 and the post retaining cap 16 are removed from contact with the post. The user then may position the post driver 10 at the site where the next post is to be driven with the process repeated.

It will be appreciated that the combination of the stabilizing means 48 and the dual hammer lifting means 26 allow the post driver 10 of the present invention to provide a more stable platform for operating the hammer assembly 14 in comparison to post drivers having a single rear-mounted hammer lifting means. In the preferred embodiment of this invention, a control panel (not shown) is provided to control lifting of the hammer assembly 14, tilting of the post driver 10, as well as raising and lowering of the stabilizing means 48 using hydraulic pressure. For example, whenever the post driver 10 of the present invention is mounted to a tractor, it will be appreciated that the hydraulic pressure required to operate the post driver 10 may be provided by the tractor's own hydraulic system. It also should be appreciated that the post retaining cap 16 obviates the need for a user to manually hold a post in place, thereby increasing user safety and convenience.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to enable one of ordinary skill in the art thereby to utilize the invention in various embodiments and with various modifications as are suited to the particular use contemplated. All such modifications and variations are within the scope of the invention whenever interpreted in accordance with the breadth to which it is fairly, legally and equitably entitled.

What is claimed is:

1. A vehicle mounted post driver for the driving of a post into the ground comprising:

a frame;

a hammer assembly slideably moveable relative to said frame;

a post retaining cap aligned with the hammer assembly, said post retaining cap comprises a recess for receiving a post, said recess including a plurality of pins, said pins disposed axially parallel to said post;

stabilizing means for stabilizing the post driver depending from said frame;

a hydraulic system comprising means mounted on said frame for lifting the hammer assembly, said hydraulic system comprising a pair of hydraulic cylinders contained within said frame and extendable to lift said hammer assembly;

swiveling means for orienting the post driver, said swiveling means comprising a movable lever rigidly connected to a portion of said post driver, and mounting means for mounting the post driver to a vehicle.

2. The post driver of claim 1 wherein the stabilizing means comprises a beam and foot assembly slidably received in said frame and extendible to engage said foot assembly with the ground.

3. The post driver of claim 1 wherein the lifting means for lifting the hammer assembly and swivelling means for adjusting the orientation of the post driver are operated by hydraulic pressure.

4. The post driver of claim 3 wherein said swivelling means for adjusting the orientation of the post driver comprises a swivelling device attached to said frame and disposed with an axis of rotation extending from said frame and perpendicular to said path of movement of said hammer.

5. The post driver of claim 1 wherein the lifting means comprising a pair of hydraulic cylinders for lifting the hammer assembly are located at a first side and a second side of said hammer assembly.

6. The post driver of claim 1 wherein said stabilizing means comprises a beam and foot assembly slidably received in said frame and extendable to engage said foot assembly with said ground.

7. The post driver of claim 1 wherein said stabilizing means comprises a beam and foot assembly slidably received in said frame and extendible under influence of hydraulic pressure.

8. A vehicle mounted post driver for the driving of a post into the ground comprising:

a frame;

a hammer assembly slideably movable relative to said frame;

a post retaining cap aligned with the hammer assembly said post retaining cap includes a recess for receiving a post, said recess including a plurality of pins, said pins disposed axially parallel to said post;

stabilizing means for stabilizing the post driver, depending from said frame;

lifting means for lifting the hammer assembly, said lifting means comprising a pair of hydraulic cylinders attached to said frame and extendable to lift said hammer assembly;

swivelling means for supporting said post driver for orienting the post driver, said swivelling means comprising a movable lever rigidly connected to a portion of said post driver, and mounting means for mounting the post driver to a vehicle.

9. The post driver of claim 8 wherein the stabilizing mans comprises a beam and foot assembly slidably received in said frame and extendible to engage said foot assembly with the ground.

10. The post driver of claim 8 wherein the lifting means for lifting the hammer assembly and swivelling means for adjusting the orientation of the post driver are operated by hydraulic pressure.

11. The post driver of claim 8 wherein the lifting means comprising a pair of hydraulic cylinders for lifting the hammer assembly are located at a first side and a second side of said hammer assembly.

12. The post driver of claim 11 wherein said swivelling means for adjusting the orientation of the post driver comprises a swivelling device attached to said swivelling means and disposed with an axis of rotation extending from said swivelling means and perpendicular to said path of movement of said hammer and further comprises a lever attached rigidly to said swivelling means and moveable by a hydraulic member.

13. The post driver of claim 8 wherein said stabilizing means comprises a beam and foot assembly slidably received in said frame and extendable to engage said foot assembly with said ground.

14. The post driver of claim 13 wherein said stabilizing means comprises a beam and foot assembly slidably received in said frame and extendible under influence of hydraulic pressure.

* * * * *